US007007658B1

(12) United States Patent
Cherry et al.

(10) Patent No.: US 7,007,658 B1
(45) Date of Patent: Mar. 7, 2006

(54) VACUUM SHUTDOWN SYSTEM

(75) Inventors: Mark A. Cherry, Sandpoint, ID (US); Richard D. Course, Sandpoint, ID (US); Stephen Michael Chudyk, Sandpoint, ID (US)

(73) Assignee: SmartPlugs Corporation, Sandpoint, ID (US)

( * ) Notice: Subject to any disclaimer, the term of this patent is extended or adjusted under 35 U.S.C. 154(b) by 0 days.

(21) Appl. No.: 10/600,630

(22) Filed: Jun. 20, 2003

Related U.S. Application Data

(60) Provisional application No. 60/390,477, filed on Jun. 21, 2002.

(51) Int. Cl.
*F02B 77/00* (2006.01)

(52) U.S. Cl. ..... 123/198 DB; 261/72.1

(58) Field of Classification Search ..... 123/198 DB, 123/198 DC, 529, DIG. 11; 261/72.1, DIG. 67
See application file for complete search history.

(56) References Cited

U.S. PATENT DOCUMENTS 3,789,812 A * 2/1974 Berry et al. ..... 123/406.7
4,175,526 A * 11/1979 Phelan ..... 123/520
6,371,074 B1 * 4/2002 Keller ..... 123/198 DB
6,615,792 B1 * 9/2003 Grifka et al. ..... 123/198 DB

* cited by examiner

*Primary Examiner*—Henry C. Yuen
*Assistant Examiner*—Hyder Ali
(74) *Attorney, Agent, or Firm*—Donn K. Harms

(57) ABSTRACT

A device for shutdown of an internal combustion engine which provides for the cessation of fuel and air mixture in a carburetor supplying the cylinders of the engine with fuel for ignition. The device features a conduit in sealed engagement with the fuel supply bowl of the carburetor which may by switched from engagement between the atmosphere or a negative air pressure supply. When switched to communication with negative air pressure the device causes a vacuum in the fuel bowl of the carburator thereby ceasing fuel flow and shutting down the engine due to lack of fuel.

20 Claims, 1 Drawing Sheet

VACUUM SHUTDOWN SYSTEM

This application claims the benefit of U.S. Provisional Application Ser. No. 60/390,477 filed Jun. 21, 2002.

FIELD OF THE INVENTION

The disclosed device relates stopping an internal combustion engine from its running mode. More particularly it relates to a shutdown system and method creating that shutdown system which will cause carbureted engines to cease running when engaged. The shutdown system herein disclosed provides for switched communication of a vacuum or negative air pressure, inside the reservoir or the "bowl" of a carburetor mixing fuel and air and communicating that mixture into an engine intake manifold. Once the vacuum is induced into the bowl of the carburetor, it ceases to feed fuel to the engine causing the engine to immediately shut down.

BACKGROUND OF THE INVENTION

Internal combustion engines have for many years been using carburetors to supply fuel to the engine through a vacuum created in an intake manifold communicating between the cylinders and the carburetor. Such carbureting devices generally mix the chosen fuel, such as gasoline, with air from the atmosphere, to derive a mixture suitable for ignition in the cylinder chambers of the engine.

In recent years with the advent of ever stricter air pollution regulations it has become important to lean out the mixture exploded in the cylinders to alleviate air pollution. Also in recent years engines have become prone to "run on" or continued ignition by the cylinders of the fuel mixture after the engine has been deactivated. Such a problem is generally caused by higher cylinder temperatures during operation which cause continued cylinder explosions of the air fuel mixture even without a spark plug or other igniter to fire the mixture in the cylinder. Other engines just need a means to shut them down once cessation of running is desired.

As such, there exists a need for a device that provide a means to immediately and permanently cease the flow of fuel through carburetors mounted to supply fuel and air to internal combustion engines. Such a device should be simple in operation, and easily installed universally on engines employing carburetors. Such a device should be easy to employ as either a retrofit to existing carburetors already on running engines, as well as in original equipment manufacture of new carburetors or newly assembled engines.

SUMMARY OF THE INVENTION

As shown and described herein, the disclosed device is easily employed on newly manufactured carburetors and engine systems, or as a retrofit to older carburetors and systems already in use on operating internal combustion engines.

The device features one or a plurality of tubes or other sealed conduits which communicate respectively with the fuel bowls of one or a plurality of carburetors. The best mode uses the existing bowl vent which generally installed on most carburetors to allow the bowl to communicate with the outside atmosphere as the fuel level in the bowl or carburetor reservoir is filled by the fuel line and drained by the jets and manifold suction during operation of the carburetor. A fitting or other cooperative means of sealed communication of the tube with the bowl is used.

The device may either be retrofit to existing carburetor systems by the attachment of the tubes in sealed communication with carburetor vents at a first end, or, it may be designed into newly manufactured carburetors. The vacuum carrying tubes would communicate with a valve at a second end which would allow the bowl, through the tube, to communicate with one of the atmosphere, or, a vacuum source, depending on the position of the valve.

During normal operation of the engine the carburetor would be vented to the atmosphere through the tube and the valve in a first position. When shut down is desired, a valve would be activated by moving it to a second position which that would change the tubes communication from one with the atmosphere, to sealed communication with a vacuum source such as a tank with negative pressure or a pump to create it. The tube being in sealed communication with the bowl or other fuel reservoir of the carburetor, through the valve, creates a negative air pressure in the bowl causing fuel flow to cease through the carburetor jets, passages, or venturi, to the carburetor throat feeding fuel to the engine intake manifold. The result being that the engine shuts down from lack of fuel. When the engine is to be run again, the valve is simply moved back to the first position communicating between the bowl and the atmosphere again, and normal operation of the carburetor will resume.

The device as herein disclosed in the drawings and specification may be applied to one or a plurality of carburetors feeding fuel to an engine and as noted, it may be employed as a method using a kit for retrofit to existing engines using fittings that would be communicate through the bowl vent, or lacking a vent, into the bowl through the body of the carburetor, and allow for the cooperative sealed engagement of the tube which communicates to the two way valve providing communication with one of the atmosphere or the vacuum source. Or, the device may be sold as original equipment with the fittings already in place in the carburetor and the tubes and valve ready to connect and build. If a retrofit, the method of retrofitting would also be a step by step process of attaching the tubes to the vents on the carburetors and assembling the device.

As shown in the drawing the source of the vacuum could be from manifold vacuum which evacuates air pressure from a vacuum tank effectively storing vacuum or negative pressure for communication with the carburetors when the valve, in the second position, connects the tube to the tank instead of to the atmosphere. Additional safety may be provided by a check valve to vent any fuel that might form or be sucked into the tube communicating with the various carburetor bowls.

An object of this invention is the provision of an engine shut down system that is easily attached universally to carbureted internal combustion engines.

Another object of this invention is the provision of a method to retrofit existing engines supplied with fuel by carburetors in either the automotive, motorcycle, aviation, or small engine industry.

An additional object of this invention is the provision of such an engine shut down system that can be easily employed on both existing engines or on newly manufactured engines and carburetors.

These together with other objects and advantages which will become subsequently apparent reside in the details of the construction and operation as more fully hereinafter described and claimed, reference being had to the accompanying drawings forming a part thereof, wherein like numerals refer to like parts throughout.

While certain specific relationships, materials and other parameters have been detailed in the above description of preferred embodiments, those can be varied, where suitable, with similar results. Other applications, variation and ramifications of the present invention will occur to those skilled in the art upon reading the present disclosure. Those are intended to be included within the scope of this invention.

BRIEF DESCRIPTION OF THE DRAWINGS

The accompanying drawings, which are incorporated in and form a part of this specification, illustrate embodiments of the invention and together with the description, serve to explain the principles of this invention.

DETAILED DESCRIPTION OF THE PREFERRED EMBODIMENTS

Figure 1:
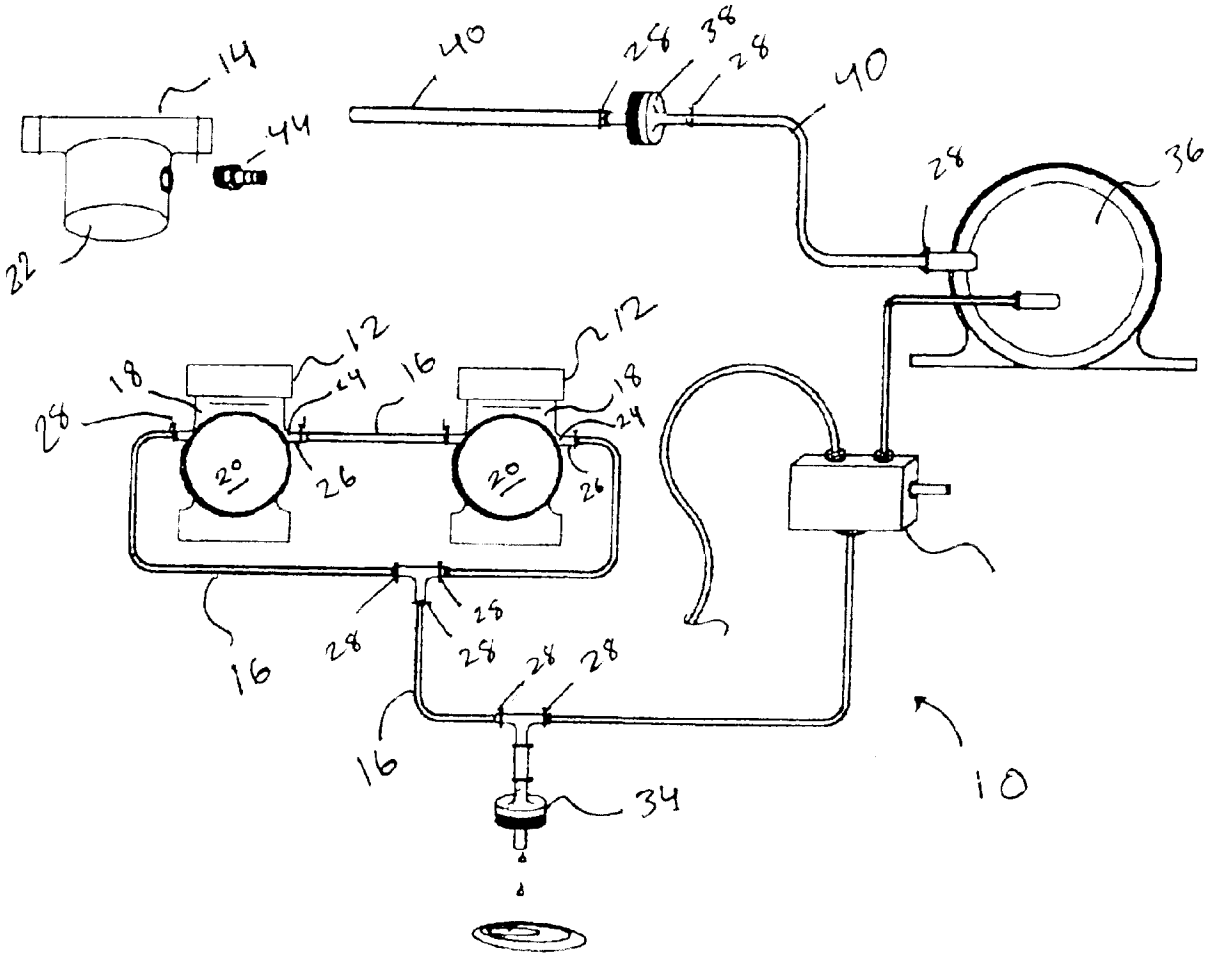
FIG. 1 depicts a view of the engine shut down system which can be employed on one or a plurality of carburetors which mix fuel and air for any internal combustion engine.

Referring now to drawing 1, wherein similar parts of the invention are identified by like reference numerals the shutdown system device 10 for carbureted internal combustion engines is shown. The device 10 as well as the method of attaching and employing the device 10 as can be seen in the drawing, is easily employed on existing, as well as newly manufactured carburetors 12 which mount to intake manifolds 14 to supply the air and fuel mixture to internal combustion engines used on automobiles, trucks, motorcycles, generators, airplanes, and other devices powered by carbureted internal combustion engines.

As can be seen, the device 10 may be easily installed as retrofit to older carburetors 12 and systems already in use on operating internal combustion engines. Or, it can be employed in the manufacture of new engine systems and new carburetors 12 to allow for installation at the factory prior to sale.

In operation, the device 10 employs one or a plurality of tubes 16 or other sealed conduits which communicate respectively with the fuel bowls 18 or fuel storage cavities which store a small amount of fuel for distribution through the jets and down the throat 20 of one or a plurality of carburetors 12. Such carburetors 12 as noted above, receive fuel from the fuel tank through a pump or other means and store a small amount in the bowl 18 for use by the carburetor 12 in the mixing process. A small valve conventionally regulates the fuel input into the bowl 18 and shuts the fuel off once a predetermined fuel level in the bowl is reached. As this fuel storage bowl 18 is filled, the cavity forming the bowl 18 must evacuate air therein to make room for the fuel. Also, as fuel is used by the carburetor 12 in the mixing process which delivers it down the throat 20 and into the intake manifold throat 22, to allow for continued fuel flow from the bowl 18 and down the throat 20, air must be allowed back into the bowl 18 through a vent 24 in the bowl which communicates through the carburetor sidewall forming the cavity which determines the capacity of the bowl 18. It is this requirement for air to enter and leave the bowl 18 during the raising and lower of the fuel level in the bowl 18 which the disclosed device 10 and method, takes advantage of to shut down the engine receiving the mixture from the intake manifold 14 through the intake manifold throat 22.

In a preferred embodiment, the existing bowl vent 24 which generally installed on most carburetors to allow the bowl 18 to vent air to outside atmosphere as the fuel level in the bowl 18 rises from fuel supplied by the fuel pump and to intake air as the fuel level drops when fuel is drained by the carburetor jets and conduits drawn by manifold suction during operation of the carburetor 12. A bowl fitting 26 or other cooperative means of sealed communication of the tube 16 with the bowl 18 is employed with a means to maintain sealed engagement of the tube 16 on the bowl fitting 26 such as a clamp 28.

As noted above, the device 10 may either be retrofit to existing carburetor systems by the attachment of the tubes 16 in sealed communication with bowl vents 24 at a first end, or, it may be designed into newly manufactured carburetors 12 using a fitting communicating through the wall into the top of the bowl 18 where the necessary air pocket is maintained. At a second end, the vacuum carrying tubes 16 would communicate with a means for switching the between communication with the atmosphere and a vacuum source or negative air pressure supply such as a mechanically or electronically activated valve 30. The valve 30 would default to allow communication of the tube 16 with the atmosphere which would communicate with the valve 30 at a first intake point 32. This default position of the valve 30 communicating with the atmosphere would form a conduit through the valve 30 and the tube 16 to allow intake and exhaust of air in the bowl 18 during raising and lowering of the fuel level. Thus, during normal start up and operation of the engine, the bowl 18 of the one or plurality of carburetors 12 providing fuel to the engine would be vented to the atmosphere through the tube 16 and with the valve 30 in the default or first position.

Also provided in the preferred embodiment would be a check valve 34 which would be situated at the lowest point of the tube 16 between its communication with the carburetor 12 and the valve 30 which communicates air or suction to the bowl 18. This check valve 30 provides a drain for any fuel which might be sucked into the tube 16 when the valve 30 is moved from the default position to one which communicates a vacuum to the bowl 18. The check valve would be a one way valve which allows for communication of any liquid fuel gathered at the low point of the tube 16 to the atmosphere, but would close and prevent intake once the tube 16 is depressurized and the vacuum is communicated to the bowl 18 through the valve 30.

In operation, when engine shut down is desired, the valve 30 or similar means to switch between a vacuum source and the atmosphere would be activated by moving it to its second position. In the second position, the valve 30 changes the communication of the tube 16 and the bowl 18 from one with the atmosphere at the intake point 28 to a sealed communication with a vacuum source such as a tank 36 with negative pressure internally or some other means for the provision of a vacuum such as an air pump to create it.

The tube 16 being in sealed communication with the bowl 18 or other fuel reservoir of the carburetor, through the valve 30 in the second or non default position communicates a vacuum or negative air pressure into the bowl 18. Once this occurs, fuel flow from the bowl 18 into the various conduits and jets feeding the throat 20 of the carburetor 12 ceases since it can no longer low with the minimal suction provided from the communication of the throat 20 with the vacuum provided in the intake manifold throat 22. As a consequence, the mixing process of fuel with air being sucked down the throat 20 of the carburetor ceases and the engine shuts down from lack of fuel. When the engine is to be run again, the valve 30 is moved back to the first position communicating between the bowl 18 and the atmosphere at the intake point 32, and normal fuel and air mixing of the carburetor will resume.

As shown in the drawing the source of the vacuum communicated through the valve 30 to the tube 16 could be provided by the engine itself using manifold vacuum which evacuates air pressure from the tank 36 storing vacuum or negative pressure for communication with the carburetors 12 when the valve 30 is in the second position. A pump or other means of creating a vacuum in the tube 16 or the tank 36 can also be used as a vacuum source. If manifold vacuum is used to evacuate the tank 36, a one way valve 38 would generally be employed in the evacuation tube 40 communicating vacuum from the manifold 14 through a hose fitting 44 similar to the fitting communicating with the fuel bowl 18, to the tank 36, which would close communication with the manifold 14 once the engine shuts down or the negative pressure from the manifold 14 is equal to or less than the negative pressure in the tank 36.

The device 10 and method as herein disclosed in the drawings and specification may be applied to one or a plurality of carburetors 12 feeding fuel to an engine and as noted. If employed as a method, it would involve forming a sealed communication with the bowl 18, attaching a- tube to the sealed communication point at one end, attaching the tube to means for switching between a vacuum source and the atmosphere at the other end of the tube; and using the means for switching to either provide air to the bowl or vacuum to the bowl the allow the engine to run, or shut it off respectively.

The device herein shown in the drawings and described in detail herein discloses arrangements of elements of particular construction and configuration, for illustrating preferred embodiments of structure and method of operation of the present invention. It is to be understood, however, that elements of different construction and configuration and other arrangements thereof, other than those illustrated and described, may be employed to provide the vacuum shutdown system for a carbureted engine in accordance with the spirit of this invention. Any and all such changes, alternations and modifications as would occur to those skilled in the art are considered to be within the scope of this invention as broadly defined in the appended claims.

Further, while the present invention has been described herein with reference to particular embodiments thereof, a latitude of modifications, various changes and substitutions are intended in the foregoing disclosure, and will be appreciated that in some instance some features of the disclosed invention will be employed without a corresponding use of other features and/or in different combinations with other features without departing from the scope of the invention as set forth in the following claims.

What is claimed is:

1. A vacuum shutdown apparatus for cessation of fuel and air mixture in a carburetor being supplied with fuel from a reservoir thereby shutting down an engine fueled by said carburetor, comprising:

a conduit having a first end and a second end;

means for sealed communication of said first end with the fuel storage bowl providing fuel to an air and fuel mixing chamber in at least one carburetor;

a vacuum source;

an atmosphere inlet; and means for switching communication of said second end of said conduit between a first communication with said atmosphere inlet and a second communication with said vacuum source, whereby fuel flow in said carburetor to said air and fuel mixing chamber substantially ceases when said means for switching communication is in said second communication thereby creating negative air pressure in said fuel storage bowl relative to said air and fuel mixing chamber.

2. The vacuum shutdown apparatus of claim 1 additionally comprising:

said conduit having low point between said first end and said second end; and means to communicate liquid trapped in said conduit to the atmosphere when said means for switching communication of said second end of said conduit is in said first communication with said atmosphere.

3. The vacuum shutdown apparatus of claim 1 wherein said means for switching communication of said second end of said conduit between a first communication with said atmosphere inlet and a second communication with said vacuum source comprises:

a valve;

said valve communicating in a first sealed engagement with said second end of said conduit;

said valve communicating in a second sealed engagement with said vacuum source;

said valve communicating in a third engagement with the atmosphere;

said valve having a default position communicating said second end of said conduit with said atmosphere; and said valve switchable to a second position providing a substantially sealed communication between said second end of said conduit and said vacuum source.

4. The vacuum shutdown apparatus of claim 2 wherein said means for switching communication of said second end of said conduit between a first communication with said atmosphere inlet and a second communication with said vacuum source comprises:

a valve;

said valve communicating in a first sealed engagement with said second end of said conduit;

said valve communicating in a second sealed engagement with said vacuum source;

said valve communicating in a third engagement with the atmosphere;

said valve having a default position communicating said second end of said conduit with said atmosphere; and said valve switchable to a second position providing a substantially sealed communication between said second end of said conduit and said vacuum source.

5. The vacuum shutdown apparatus of claim 1 wherein said vacuum source comprises:

a tank having a negative air pressure formed therein; and a tube communicating between said tank and said means for switching communication of said second end of said conduit between a first communication with said atmosphere inlet and a second communication with said vacuum source.

6. The vacuum shutdown apparatus of claim 2 wherein said vacuum source comprises:

a tank having negative air pressure formed therein; and a tube communicating between said tank and said means for switching communication of said second end of said conduit between a first communication with said atmosphere inlet and a second communication with said vacuum source.

7. The vacuum shutdown apparatus of claim 3 wherein said vacuum source comprises:

a tank having negative air pressure formed therein; and a tube communicating between said tank and said means for switching communication of said second end of said conduit between a first communication with said atmosphere inlet and a second communication with said vacuum source.

8. The vacuum shutdown apparatus of claim 5 additionally comprising:

a vacuum tube;

a one way valve;

said vacuum tube communicating through said one way valve between said tank and an intake manifold of an engine, said intake manifold having a suction when said engine is operating;

said negative air pressure being formed in said tank by said suction; and said one way valve preventing gas from entering said tank through said vacuum tube when said suction from said intake manifold ceases thereby maintaining said negative air pressure in said tank when said engine ceases operation.

9. The vacuum shutdown apparatus of claim 6 additionally comprising:

a vacuum tube;

a one way valve;

said vacuum tube communicating through said one way valve between said tank and an intake manifold of an engine, said intake manifold having a suction when said engine is operating;

said negative air pressure being formed in said tank by said suction; and said one way valve preventing gas from entering said tank through said vacuum tube when said suction from said intake manifold ceases thereby maintaining said negative air pressure in said tank when said engine ceases operation.

10. The vacuum shutdown apparatus of claim 7 additionally comprising:

a vacuum tube;

a one way valve;

said vacuum tube communicating through said one way valve between said tank and an intake manifold of an engine, said intake manifold having a suction when said engine is operating;

said negative air pressure being formed in said tank by said suction; and said one way valve preventing gas from entering said tank through said vacuum tube when said suction from said intake manifold ceases thereby maintaining said negative air pressure in said tank when said engine ceases operation.

11. A method of shutting down operation of an internal combustion engine being fueled by a carburetor creating an air and fuel mixture and communicating that air fuel mixture to at least one engine cylinder for ignition, comprising:

engaging a first end of tube in a sealed communication with the fuel storage bowl of said carburetor; and engaging a second end of said tube with a source of negative air pressure to create negative air pressure in said fuel storage bowl to thereby cease fuel flow in said carburetor and shut down said engine.

12. A method of shutting down operation of an internal combustion engine being fueled by a carburetor creating an air and fuel mixture and communicating that air fuel mixture to at least one engine cylinder for ignition, comprising:

engaging a first end of tube in a sealed communication with the fuel storage bowl of said carburetor;

engaging said second end of said tube with a valve switch which communicates said second end of said tube with one of said atmosphere or a source of negative air pressure;

moving said valve switch from a first position wherein said second end of said tube communicates with said atmosphere, to a second position wherein said second end of said tube communicates with said source of negative air pressure to thereby cease fuel flow in said carburetor and shut down said engine.

13. A vacuum shutdown apparatus for cessation of fuel and air mixture in a carburetor being supplied with fuel from a reservoir, comprising:

a conduit having a first end and a second end;

said first end of said conduit adapted for sealed engagement with the distal end of a bowl vent tube extending from the exterior of a body forming a carburetor and in sealed communication with an internal fuel storage bowl providing fuel to an air and fuel mixing chamber in said carburetor;

a vacuum source;

an atmosphere inlet; and means for switching communication of said second end of said conduit between a first communication with said atmosphere inlet and a second communication with said vacuum source, whereby fuel flow in said carburetor to said air and fuel mixing chamber substantially ceases when said means for switching communication is in said second communication.

14. The vacuum shutdown apparatus of claim 13 additionally comprising:

said conduit having low point between said first end and said second end; and means to communicate liquid trapped in said conduit to the atmosphere when said means for switching communication of said second end of said conduit is in said first communication with said atmosphere.

15. The vacuum shutdown apparatus of claim 13 wherein said means for switching communication of said second end of said conduit between a first communication with said atmosphere inlet and a second communication with said vacuum source comprises:

a valve;

said valve communicating in a first sealed engagement with said second end of said conduit;

said valve communicating in a second sealed engagement with said vacuum source;

said valve communicating in a third engagement with the atmosphere;

said valve having a default position communicating said second end of said conduit with said atmosphere; and said valve switchable to a second position providing a substantially sealed communication between said second end of said conduit and said vacuum source.

16. The vacuum shutdown apparatus of claim 14 wherein said means for switching communication of said second end of said conduit between a first communication with said atmosphere inlet and a second communication with said vacuum source comprises:

a valve;

said valve communicating in a first sealed engagement with said second end of said conduit;

said valve communicating in a second sealed engagement with said vacuum source;

said valve communicating in a third engagement with the atmosphere;

said valve having a default position communicating said second end of said conduit with said atmosphere; and said valve switchable to a second position providing a substantially sealed communication between said second end of said conduit and said vacuum source.

17. The vacuum shutdown apparatus of claim 13 wherein said vacuum source comprises:

a tank having a negative air pressure formed therein; and a tube communicating between said tank and said means for switching communication of said second end of said conduit between a first communication with said atmosphere inlet and a second communication with said vacuum source.

18. The vacuum shutdown apparatus of claim 14 wherein said vacuum source comprises:

a tank having negative air pressure formed therein; and a tube communicating between said tank and said means for switching communication of said second end of said conduit between a first communication with said atmosphere inlet and a second communication with said vacuum source.

19. The vacuum shutdown apparatus of claim 15 wherein said vacuum source comprises:

a tank having negative air pressure formed therein; and a tube communicating between said tank and said means for switching communication of said second end of said conduit between a first communication with said atmosphere inlet and a second communication with said vacuum source.

20. The vacuum shutdown apparatus of claim 17 additionally comprising:

a vacuum tube;

a one way valve;

said vacuum tube communicating through said one way valve between said tank and an intake manifold of an engine, said intake manifold having a suction when said engine is operating;

said negative air pressure being formed in said tank by said suction; and said one way valve preventing gas from entering said tank through said vacuum tube when said suction from said intake manifold ceases thereby maintaining said negative air pressure in said tank when said engine ceases operation.

* * * * *